United States Patent [19]

Young et al.

[11] Patent Number: 4,463,898

[45] Date of Patent: Aug. 7, 1984

[54] RAIL FASTENERS

[76] Inventors: Hartley F. Young, 200 Coburns Rd., Melton, Victoria; Wally A. Remes, No. 7 S. Court, Redwood Park, South Australia, both of Australia

[21] Appl. No.: 237,124

[22] PCT Filed: Jul. 3, 1980

[86] PCT No.: PCT/AU80/00028

§ 371 Date: Feb. 10, 1981

§ 102(e) Date: Feb. 10, 1981

[87] PCT Pub. No.: WO81/00121

PCT Pub. Date: Jan. 22, 1981

[30] Foreign Application Priority Data

Jul. 5, 1979 [AU] Australia ..... PD9465

[51] Int. Cl.[3] ..... E01B 9/30

[52] U.S. Cl. ..... 238/310; 238/349; 238/351

[58] Field of Search ..... 238/310, 315, 283, 349, 238/338, 351; 174/138 R

[56] References Cited

U.S. PATENT DOCUMENTS

| | | | |
|---|---|---|---|
| 3,297,253 | 1/1967 | Astley et al. | 238/349 |
| 3,460,756 | 8/1969 | Sanson | 238/338 |
| 3,463,394 | 8/1969 | Jones et al. | 238/338 |
| 3,610,526 | 10/1971 | Burwell | 238/349 X |
| 4,104,483 | 8/1978 | Seeley | 238/338 |
| 4,274,582 | 6/1981 | Fee | 238/349 |
| 4,284,238 | 8/1981 | Veroef | 238/349 |
| 4,313,563 | 2/1982 | Young | 238/349 |

FOREIGN PATENT DOCUMENTS

| | | |
|---|---|---|
| 226776 | 6/1959 | Australia . |
| 265930 | 10/1963 | Australia . |
| 415933 | 10/1969 | Australia . |

*Primary Examiner*—Joseph F. Peters, Jr.
*Assistant Examiner*—Mitchell J. Hill
*Attorney, Agent, or Firm*—Christel, Bean & Linihan

[57] ABSTRACT

A rail to tie fastening including an elastic clip (12) a clip holder (15) and a locking element (6). The locking element (6) being interposed between the foot of the rail (11) and the clip holder (15) and, between the foot of the rail (11) and the clip (12) and is forced by the clip (12) against the foot (11). The locking element (6) is so shaped that any movement of the locking element (6) parallel to the rail (11), induced by longitudinal movement of the rail (11), results in the locking element (6) wedging between the clip holder (15) and the foot of the rail (11) so increasing lateral pressure on the rail to prevent further longitudinal rail movement.

5 Claims, 5 Drawing Figures

RAIL FASTENERS

This invention relates to an improvement in elastic rail fasteners particularly those which use a rail clip and a clip holder. The purpose of the clip holder is to secure the rail clip to a rail sleeper and enables the rail clip to bear down on the rail flange.

Numerous elastic rail fastening systems of this type have been devised. Any rail fastening system must be able to maintain the rail in position under the normal stress conditions arising from use of the rails and from environmental stresses particularly thermal stresses. Modern rail systems are adopting welded rails and thermal stresses are a predominant factor in welded rails. It has been observed that a major long term difficulty with rails is the tendency of the rails to move in the predominant direction of travel for trains on the rail track. This tendency is called rail creep and it is most important that any elastic rail fastening systems not only prevent lateral rail movement but also prevent axial movement or rail creep.

Past attempts to reduce rail creep have concentrated on increasing the hold down force of the rail clip on the rail flange or on increasing the frictional resistance between the rail, the sleeper and the clip by, for example, carefully selecting material to be used as rail pads between the rail and the sleeper.

It is an object of this invention to reduce rail creep as compared to conventional elastic fastening systems.

To this end the present invention provides a locking element for use with a rail fastening system comprising an elastic rail clip, a clip holder adapted to hold the clip in position on the flange of the rail. The locking element is adapted to lie between the rail flange and the rail clip holder, and the locking element is held down onto the rail flange by the rail clip, and the clip holder interfits with the locking element such that any movement of the locking element in a direction parallel to the rail axis is at least partially translated into a lateral pressure of the locking element against the rail.

Ideally a portion of the abutting surfaces of the locking element and the clip holder are inclined to the axis of the rail so that any movement of the locking element parallel to the rail results in the locking element being wedged inwardly against the rail, thereby increasing contact pressure on the rail from a horizontal lateral direction. Prior art fastening systems only applied a vertical hold down force to the rail flange. The present invention however is able to apply both a vertical and horizontal force to the rail and this additionally restrains rail creep. Either locking element or the clipholder includes a U shaped recess into which the other part interfits and either the corners of said U have a radius of curvature of at least 6 mm or the sides of said U are inclined to the base of said U at an angle of at least 100°.

The locking element of this invention ideally doubles as an insulator between the rail clip and the rail flange. In the prior art insulators of this kind have been described for example in U.S. Pat. Nos. 3,610,526 to Burwell (see FIG. 4), 3,460,756 to Sanson, 3,463,394 to Jones et al. None of the insulators described in these patents or insulators used in practice in the prior art functioned as locking elements. The interaction of the surface of the insulator against the clip holder in the prior art did not result in longitudinal movement of the insulator being translated into lateral pressure on the edge of the rail foot. In each of the prior art insulators, the insulators and their associated rail clip holders are not shaped to provide a wedge like interfitting. Rather the angles at the corners of the rail clip holders and internal corners of the insulators adjacent the clip holders are effectively right angles.

From the above it can be seen that the locking element of the invention must be shaped to lie on top of the rail flange and on the shoulder or side of the rail flange so that it lies between the rail clip and the top surface of the rail flange and lies between the clip holder and the side of the rail flange. Preferably the locking element includes a U shaped portion which surrounds the clip holder. The internal faces of the U portion, which abut the rail clip are either curved or inclined inwardly toward the rail ensuring that longitudinal movement is translated into the lateral direction toward the rail. It is preferred to select the material for the locking element on two criteria: strength and frictional resistance of the surface. Both metal or a reinforced plastic are considered to be suitable.

The rail clip and clipholder preferred for use with the locking element of this invention are described in Australian patent application 54004/79.

A preferred embodiment of this invention will now be described in relation to FIGS. 1 to 4 of the drawings.

Figure 1:
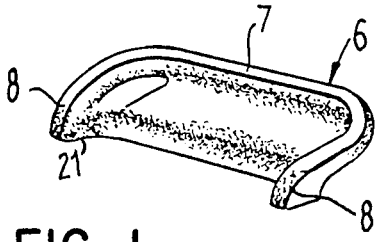
FIG. 1 is a pictorial view of the locking element.

The locking element 6 includes a portion 7 which lies on the rail flange and two shoulders 8 which encompass the clip holder. The element further comprises an outer rim 9 and the shoulders include in their leading edge the inclined wedging surface 21.

Figure 3:
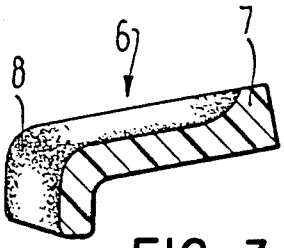
FIG. 3 is a sectional view taken about on line 3—3 in FIG. 2.
Figure 4:
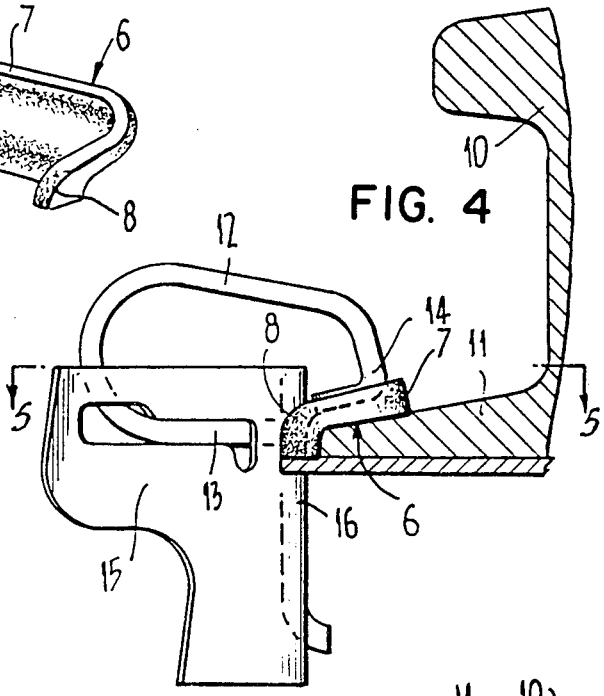
FIG. 4 is a sectional view of a rail fastening system incorporating the locking element.
Figure 2:
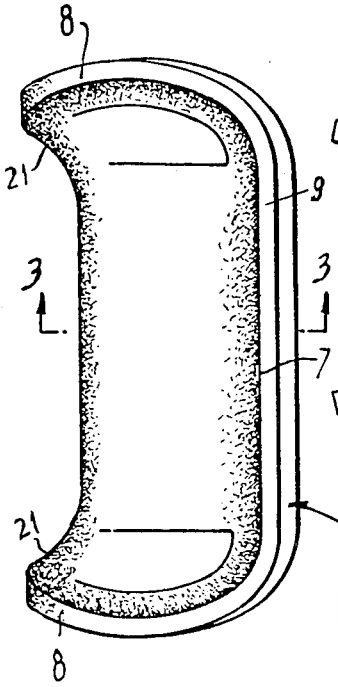
FIG. 2 is a plan view of the locking element.
Figure 5:
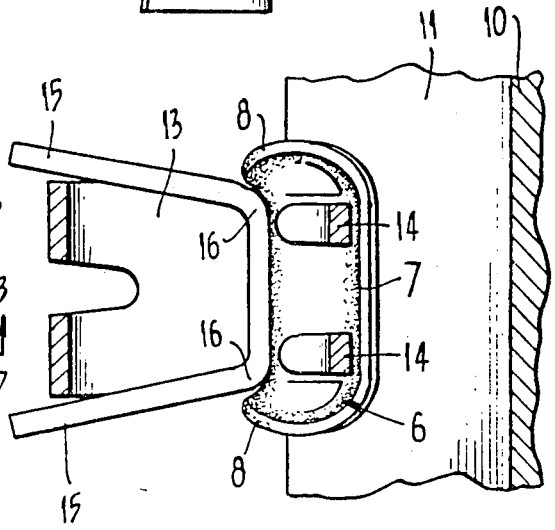
FIG. 5 is a plan view of the system shown in FIG. 4 and taken about on line 5—5 in FIG. 4.

As shown in FIGS. 3 and 4 the rail fastening system comprises a rail 10 with a rail flange 11, a rail clip 12 secured in clip holder 15. The rail clip comprises a base portion 13 and spring portion 14 which seats on the locking element portion 7 and effectively holds down the rail flange. The clip holder is formed from pressed metal plate and has rounded shoulders 16 which seat within the shoulders 8 of locking element 6. In particular, the rail clip 12 is an elastic, U-shaped member having base 13 and two arms extending therefrom providing the spring portion 14. The base 13 is adapted to be secured by clip holder 15 to the tie outwardly spaced from the foot of rail 10. The arms of spring portion 14 are bent inwardly beyond base 13 and oriented for contact with the flange of rail 10 such that the arms are deflected upwardly relative to rail 10 to develop downward clamping forces tending to hold rail 10 on the tie. Preferably each arm of spring portion 14 is tapered and this tapering is preferably substantially uniformly over the entire length of each arm. Clip holder 15 is adapted to be secured to the rail tie and has a general U shaped body portion with the sides of the U being slotted toward the base of the U and the slots adapted to receive the base 13 of clip 12. The U cross section of clip holder 15 is in the horizontal plane and the slots are generally horizontal. The sides of the U slope inwardly to guide clip 12 into position and to enable insertion of the clip base 13 into the slots.

Any rail creep will tend to drag the locking element past the clip holder but the wedging action of the surface 21 of shoulders 8 of the locking element 6 and shoulders 16 of the clip holder 15 will increase the lateral hold of the locking elements on the rail flange.

In this embodiment the rail is electrified and the locking element 6 doubles as an insulator and is accordingly composed of glass filled nylon. To improve the friction properties of the locking element the face of the locking element which abuts the rail may be roughened or textured either by sandblasting or other suitable means.

A comparison test was carried out with an insulator which did not produce a lateral wedging action by dragging a rail through the rail seat past the clipholder and measuring the resistance force. Then the test was repeated with an identical insulator except that a lateral wedging action was produced according to this invention. These tests were repeated several times.

In each case there was a significant increase in the force required to achieve significant rail creep when the locking element of this invention was used. Significant rail creep is considered to occur with rail movement of from 3 to 6 mm. The smallest increase in rail creep resistance force between using a locking element which created no wedging action and the locking element of this invention was 79% while the largest difference was 110%.

The locking element insulator 6 is a key element in preventing rail creep (i.e. longitudinal movement of the rail). As well because it is a separate part from the clip holder and is subject to more stress it can be easily and inexpensively replaced without replacement of the clip holder which is not the case in some prior art systems where clip holders encapsulated in insulating plastic have been used.

Thus the present invention clearly provides a marked improvement over prior art fastening systems without the need of increasing the hold down force capacity of the rail clip. Moreover, the increased cost in making fastening systems of the present invention is small or negligible where insulators are required in any case.

We claim:

1. A rail fastening system comprising an elastic rail clip, a clip holder adapted to hold the clip in position on the flange of the rail and a locking element being adapted to lie between the rail flange, the rail clip and the clip holder, said rail having a longitudinal axis, said locking element being held down onto the rail flange by the rail clip to apply a generally vertical holding force to the rail and said clip holder interfitting with said locking element such that any movement of said locking element induced by the rail in a direction parallel to the rail longitudinal axis is at least partially translated into a lateral pressure of said locking element against said rail in an amount sufficient to apply a generally horizontal holding force to the rail, said vertical and horizontal forces serving to retard longitudinal movement of the rail, said clipholder having an external face complementary in shape with said locking element to provide a wedge-like interfitting, the complementary shape being in the form of a U wherein the corners of the U have a radius of curvature sufficient to provide a wedging action which translates said movement of said locking element into said lateral pressure and where each side of the U is inclined at an angle to the base of the U sufficient to provide a wedging action which translates movement of said locking element into said lateral pressure.

2. A system as claimed in claim 1 wherein said locking element includes a U shaped portion which fits about the rail clip holder and the corners of said U portion have a radius of curvature sufficient to provide a wedging action which translates said movement of said locking element into said lateral pressure.

3. A system as claimed in claim 1 wherein said locking element includes a U shaped portion which fits about the rail clip holder and each side of said U portion is inclined at an angle to the base of said U portion sufficient to provide a wedging action which translates said movement of said locking element into said lateral pressure.

4. A system as claimed in claim 1 in which the locking element fits within a U shaped recess of said clip holder and the radius of curvature of the corners of said U shaped recess is sufficient to provide a wedging action which translates said movement of said locking element into said lateral pressure.

5. A system as claimed in claim 1 wherein the locking element fits within a U shaped recess of said rail clip holder and each side of said U shaped recess is inclined at an angle to the base of said U shaped recess sufficient to provide a wedging action which translates said movement of said locking element into said lateral pressure.

* * * * *